US011454223B2

(12) United States Patent
Wang

(10) Patent No.: US 11,454,223 B2
(45) Date of Patent: Sep. 27, 2022

(54) DIRECT DRIVE AIR PUMP

(71) Applicant: Wei-Chi Wang, Tainan (TW)

(72) Inventor: Wei-Chi Wang, Tainan (TW)

( * ) Notice: Subject to any disclaimer, the term of this patent is extended or adjusted under 35 U.S.C. 154(b) by 209 days.

(21) Appl. No.: 16/526,167

(22) Filed: Jul. 30, 2019

(65) Prior Publication Data

US 2021/0033078 A1 Feb. 4, 2021

(51) Int. Cl.

| | |
|---|---|
| ***F04B 9/02*** | (2006.01) |
| ***F04B 39/00*** | (2006.01) |
| ***F04B 7/02*** | (2006.01) |
| ***F04B 17/03*** | (2006.01) |
| *F04B 35/04* | (2006.01) |
| *F04B 35/01* | (2006.01) |

(52) U.S. Cl.

CPC ..... *F04B 9/025* (2013.01); *F04B 7/0266* (2013.01); *F04B 17/03* (2013.01); *F04B 39/0027* (2013.01); *F04B 35/01* (2013.01); *F04B 35/04* (2013.01); *F04B 39/0016* (2013.01)

(58) Field of Classification Search

CPC .... F04B 9/025; F04B 39/0027; F04B 7/0266; F04B 17/03; F04B 35/04; F04B 35/01; F04B 39/121; F04B 39/123; F04B 39/0016; F04B 39/1086; F04B 39/125

See application file for complete search history.

(56) References Cited

U.S. PATENT DOCUMENTS

| | | | | |
|---|---|---|---|---|
| 6,716,003 | B2 * | 4/2004 | Chen | F04B 35/01 417/368 |
| 7,273,358 | B2 * | 9/2007 | Wang | F04B 35/04 417/360 |
| 2004/0131489 | A1 * | 7/2004 | Leu | F04B 27/005 417/569 |
| 2006/0034708 | A1 * | 2/2006 | Thomas | F04B 35/04 417/416 |
| 2006/0245952 | A1 * | 11/2006 | Chen | F04B 39/066 417/415 |
| 2008/0240943 | A1 * | 10/2008 | Wang | F04B 39/0016 417/361 |

* cited by examiner

*Primary Examiner* — Charles G Freay
*Assistant Examiner* — Lilya Pekarskaya
(74) *Attorney, Agent, or Firm* — Thomas | Horstemeyer, LLP

(57) ABSTRACT

A direct drive air pump has a motor and a pumping mechanism connected to an end of the motor, and further has an auxiliary pumping mechanism connected to the other end of the motor, and a tube connected with the pumping mechanism and the auxiliary pumping mechanism. In each one of the pumping mechanism and the auxiliary pumping mechanism, a cylindrical body has a top plate having an exhaust hole. A single O-ring is used to seal between the cylindrical body and a cylindrical cover for reducing the sealing portions. A valve block of a non-return valve can co-work with a spring for opening and closing the exhaust hole. The valve block is soft for closing the exhaust hole well and reducing the noise of collision between the valve block and the top plate.

9 Claims, 10 Drawing Sheets

DIRECT DRIVE AIR PUMP

BACKGROUND OF THE INVENTION

Field of the Invention

The present invention relates to an air pump, and more particularly to a direct drive air pump that can solve the problems that the conventional air pump has many portions to seal, and the noise is loud.

Description of Related Art

With reference to FIGS. 9 and 10, a conventional air pump has a motor 90, a cylinder 91, a cylindrical body 92, a cylindrical cover 95, a piston assembly 94, and a non-return member 93. The cylinder 91 is disposed on an end of the motor 90. The cylinder 90 has a seat 911 and a soundproof plate 912. The seat 911 is disposed on the motor 90. The soundproof plate 912 is fastened on the seat 911 by multiple screws. The seat 911 is located between the motor 90 and the soundproof plate 912. The cylindrical body 92 is mounted on a top portion of the cylinder 91. The cylindrical cover 95 is mounted on a top portion of the cylindrical body 92. The piston assembly 94 is connected to a driving shaft of the motor 90 and is able to move upwardly and downwardly.

The non-return member 93 is disposed between the top portion of the cylindrical body 92 and a bottom portion of the cylindrical cover 95 and has a non-return valve sheet 931. The non-return valve sheet 931 is located on a top surface of a non-return plate 930 of the non-return member 93 for controlling an air hole of the non-return plate 930 to open or close. Air in the cylindrical body 92 can be compressed by the piston assembly 94. The compressed air can push the non-return valve sheet 931 of the non-return member 93 for flowing into the cylindrical cover 95 and then flowing through an outlet 951 of the cylindrical cover 95.

However, the cylindrical body 92 has a top opening formed on a top end of the cylindrical body 92 and a bottom opening formed on a bottom end of the cylindrical body 92. The non-return member 93 has to be disposed between the cylindrical body 92 and the cylindrical cover 95 for sealing. The non-return member 93 has two O-rings 932. One of the two O-rings 932 is located between a bottom surface of the non-return plate 930 of the non-return member 93 and the top end of the cylindrical body 92. The other one of the two O-rings 932 is located between a top surface of the non-return plate 930 of the non-return member 93 and the cylindrical cover 95. Sealing structure used between the cylindrical body 92 and the cylindrical cover 95 has many components, thereby increasing the cost of the sealing structure. The two O-rings 932 are co-used. The conventional air pump has many portions to seal. The compressed air in the cylindrical body 92 is prone to leakage.

Moreover, the non-return valve sheet 931 is made of metal. In use, the rigid non-return valve sheet 931 repeatedly beats the non-return plate 930 of the non-return member 93 and generates loud noise. The non-return valve sheet 931 is a thin slice and is easy to deform after repeated beating. The air hole of the non-return plate 930 can not be closed completely by the non-return valve sheet 93. The compressed air in the cylindrical body 92 is prone to leakage.

In addition, the soundproof plate 912 is fastened on the seat 911 by the screws to close an opening of the seat 911 for insulating the noise generated in use. The soundproof plate 912 is screwed on a side of the seat 911. The assembly of the soundproof plate 912 is inconvenient. Vibrations are generated by the piston assembly 94 driven by the motor 90. The screws fixed on the soundproof plate 912 may be loosened and generate noise.

To overcome the shortcomings, the present invention provides a direct drive air pump to mitigate or obviate the aforementioned problems.

SUMMARY OF THE INVENTION

The objective of the invention is to provide a direct drive air pump that can solve the problems that the conventional air pump has many portions to seal, and the noise is loud.

The direct drive air pump has a motor and a pumping mechanism. The motor has an end and a driving shaft. The driving shaft is rotatably disposed on the motor and has an end.

The pumping mechanism is connected to the end of the driving shaft of the motor, and has a cylinder, a cylindrical body, a piston assembly, a cylindrical cover, and a non-return valve.

The cylinder is disposed on the end of the motor and has a top end and a space formed in the cylinder. The driving shaft of the motor is inserted into the space of the cylinder.

The cylindrical body is disposed on the top end of the cylinder, and has a cylindrical chamber, a cylindrical wall, a cylindrical opening, and a top plate. The cylindrical chamber is formed in the cylindrical body. The cylindrical wall is formed on the cylindrical body, surrounds the cylindrical chamber, and has a top end and a bottom end. The cylindrical opening is formed through the bottom end of the cylindrical wall and communicates with the cylindrical chamber. The top plate is integratedly formed on the top end of the cylindrical wall, is located above the cylindrical chamber, and has an exhaust hole. The exhaust hole is formed through the top plate and communicates with the cylindrical chamber.

The piston assembly is connected to the driving shaft of the motor, and is located in the space of the cylinder and the cylindrical chamber of the cylindrical body. The piston assembly is driven by the motor to move upwardly and downwardly in the space of the cylinder and the cylindrical chamber of the cylindrical body.

The cylindrical cover covers the cylindrical body, is fixedly disposed on the cylinder, and has a bottom surface, an insertion recess, an air room, an abutting wall, an O-ring, and a connector. The insertion recess is formed on the bottom surface of the cylindrical cover. The air room is formed in the cylindrical cover, and is located above and communicates with the insertion recess of the cylindrical cover and the exhaust hole of the top plate. The abutting wall is formed in the cylindrical cover adjacent to the insertion recess of the cylindrical cover, is located above the insertion recess of the cylindrical cover, is disposed around the air room of the cylindrical cover, and faces the top plate. The O-ring is disposed on the abutting wall and abuts against the top plate. The connector is disposed on the cylindrical cover and has an outlet. The outlet of the connector is formed through the connector and communicates with the air room of the cylindrical cover.

The non-return valve is disposed in the air room of the cylindrical cover for controlling the exhaust hole of the top plate of the cylindrical body to open and close, and has a valve block and a spring. The valve block is a soft component and is movably disposed on the top plate of the cylindrical body. The spring is connected between the valve block and the cylindrical cover.

In addition, the direct drive air pump has the motor, the pumping mechanism, an auxiliary pumping mechanism, and a tube.

The motor has two ends and the driving shaft. The driving shaft is rotatably disposed on the motor and has two ends. The pumping mechanism is connected to one of the two ends of the driving shaft of the motor. The auxiliary pumping mechanism is connected to the other one of the two ends of the driving shaft of the motor.

Each one of the pumping mechanism and the auxiliary pumping mechanism has the cylinder, the cylindrical body, the piston assembly, the cylindrical cover, and the non-return valve.

The cylinder is disposed on a corresponding one of the two ends of the motor and has the top end and the space formed in the cylinder. The driving shaft of the motor is inserted into the space of the cylinder.

The cylindrical body is disposed on the top end of the cylinder, and has the cylindrical chamber, the cylindrical wall, the cylindrical opening, and the top plate. The cylindrical chamber is formed in the cylindrical body. The cylindrical wall is formed on the cylindrical body, surrounds the cylindrical chamber, and has the top end and the bottom end. The cylindrical opening is formed through the bottom end of the cylindrical wall and communicates with the cylindrical chamber. The top plate is integratedly formed on the top end of the cylindrical wall, is located above the cylindrical chamber, and has the exhaust hole. The exhaust hole is formed through the top plate and communicates with the cylindrical chamber.

The piston assembly is connected to the driving shaft of the motor, and is located in the space of the cylinder and the cylindrical chamber of the cylindrical body. The piston assembly is driven by the motor to move upwardly and downwardly in the space of the cylinder and the cylindrical chamber of the cylindrical body.

The cylindrical cover covers the cylindrical body, is fixedly disposed on the cylinder, and has the bottom surface, the insertion recess, the air room, the abutting wall, the O-ring, a vent, and the connector. The insertion recess is formed on the bottom surface of the cylindrical cover. The air room is formed in the cylindrical cover, and is located above and communicates with the insertion recess of the cylindrical cover and the exhaust hole of the top plate. The abutting wall is formed in the cylindrical cover adjacent to the insertion recess of the cylindrical cover, is located above the insertion recess of the cylindrical cover, is disposed around the air room of the cylindrical cover, and faces the top plate. The O-ring is disposed on the abutting wall and abuts against the top plate. The vent is formed on the cylindrical cover and communicates with the air room of the cylindrical cover. The connector is disposed on the cylindrical cover and has an outlet. The outlet of the connector is formed through the connector and communicates with the air room of the cylindrical cover.

The non-return valve is disposed in the air room of the cylindrical cover for controlling the cylindrical opening of the cylindrical body to open and close, and has the valve block and the spring. The valve block is the soft component and is movably disposed on the top plate of the cylindrical body. The spring is connected between the valve block and the cylindrical cover.

The tube is disposed between and is connected to the vent of the pumping mechanism and the vent of the auxiliary pumping mechanism.

The direct drive air pump in accordance with the present invention has the following advantages.

Reducing the Sealing Portions

The top plate is integratedly formed on the top end of the cylindrical wall and has the exhaust hole formed through the top plate. The single O-ring is used to seal between the cylindrical body and the cylindrical cover. The sealing portions in the direct drive air pump are reduced for avoiding leaking.

Reducing the Noise

The top plate is integratedly formed on the top end of the cylindrical wall and has the exhaust hole formed through the top plate. The valve block of the non-return valve can co-work with the spring for opening and closing the exhaust hole. The valve block is the soft component and is connected to the rigid top plate of the cylindrical body for well closing the exhaust hole and reducing the noise of collision between the valve block and the top plate.

Furthermore, the cylindrical cover has multiple ribs. The ribs are axially formed in the cylindrical cover at spaced intervals, are located in the air room of the cylindrical cover, and are located around the valve block for guiding the valve block to move linearly and preventing the valve block from skewing. The exhaust hole can be opened and closed correctly. In addition, multiple channels are formed in the cylindrical cover. Each one of the channels is located between two adjacent ribs. In use, the air flow can be flowed through the channels smoothly.

Moreover, the cylinder has a seat and a soundproof plate. The soundproof plate engages with the seat and is located on a first side of the seat. The assembly between the seat and the soundproof plate is convenient for improving assembly of the cylinder and decreasing the cost of the cylinder. In addition, the soundproof plate can close the first side of the seat of the cylinder. The noise generated by the movement of the piston assembly driven by the motor is insulated by the soundproof plate. The soundproof plate engages with the first side of the seat of the cylinder for preventing the soundproof plate from loosening and reducing the noise.

Furthermore, the seat has multiple engaging holes, an engaging protrusion, and a slot. The engaging holes are formed on the first side of the seat. The engaging protrusion is formed on an outer-bottom surface of the first side of the seat. The slot is formed in the first side of the seat, is located above the engaging protrusion, and is located in the first opening of the seat. The soundproof plate has a back surface, multiple engaging arms, an engaging ring, and a plug. The back surface faces the first opening of the seat and has a bottom end. The engaging arms are formed on the back surface of the soundproof plate and respectively engage with the engaging holes of the seat, respectively. The engaging ring is formed on the bottom end of the back surface of the soundproof plate, and engages with the engaging protrusion of the seat. The plug is formed on the back surface of the soundproof plate above the engaging ring, and is inserted into the slot of the seat. The soundproof plate engages with the first side of the seat for increasing the assembly stability of the cylinder.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
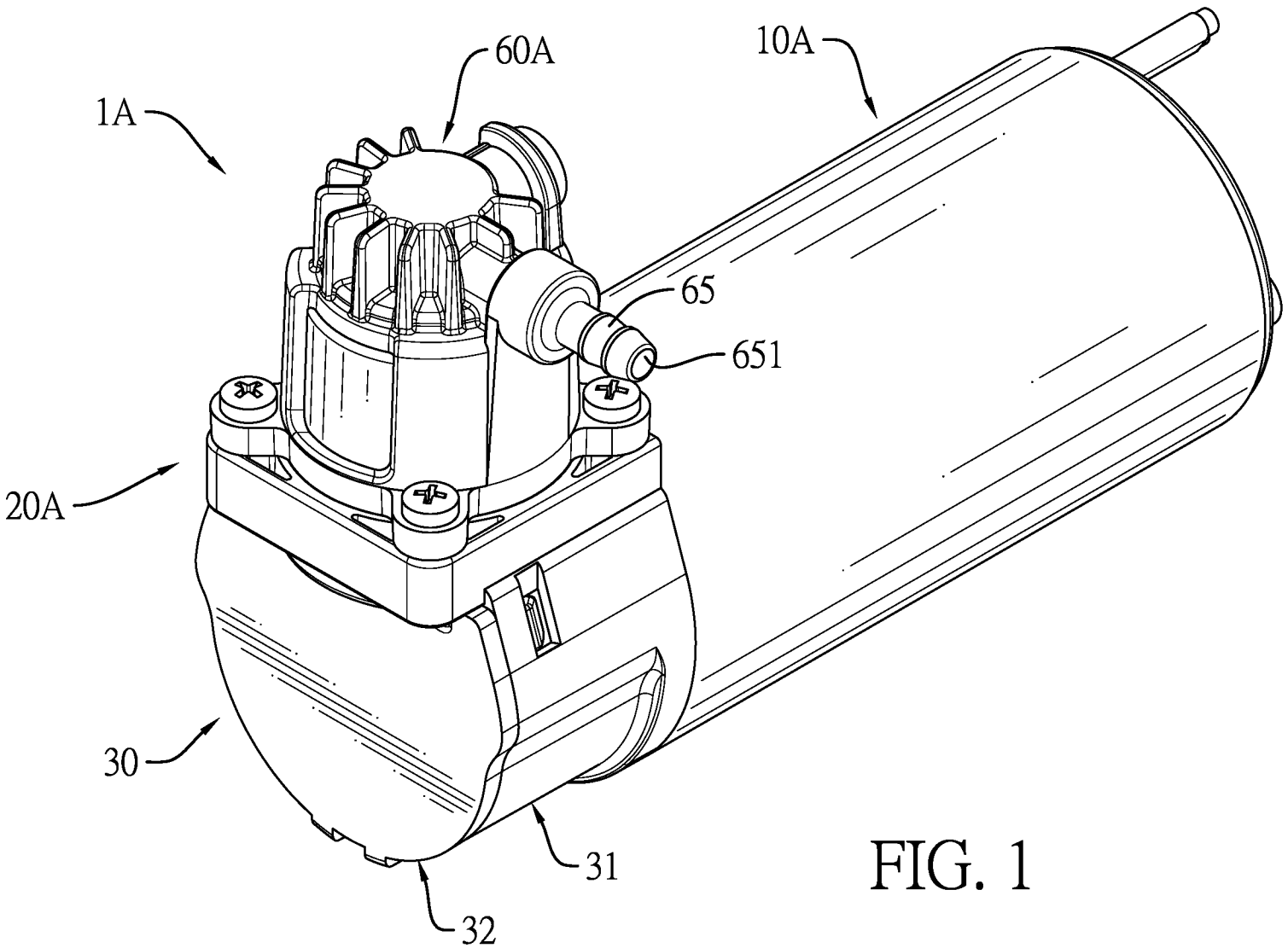
FIG. 1 is a perspective view of a first embodiment of a direct drive air pump in accordance with the present invention.
Figure 2:
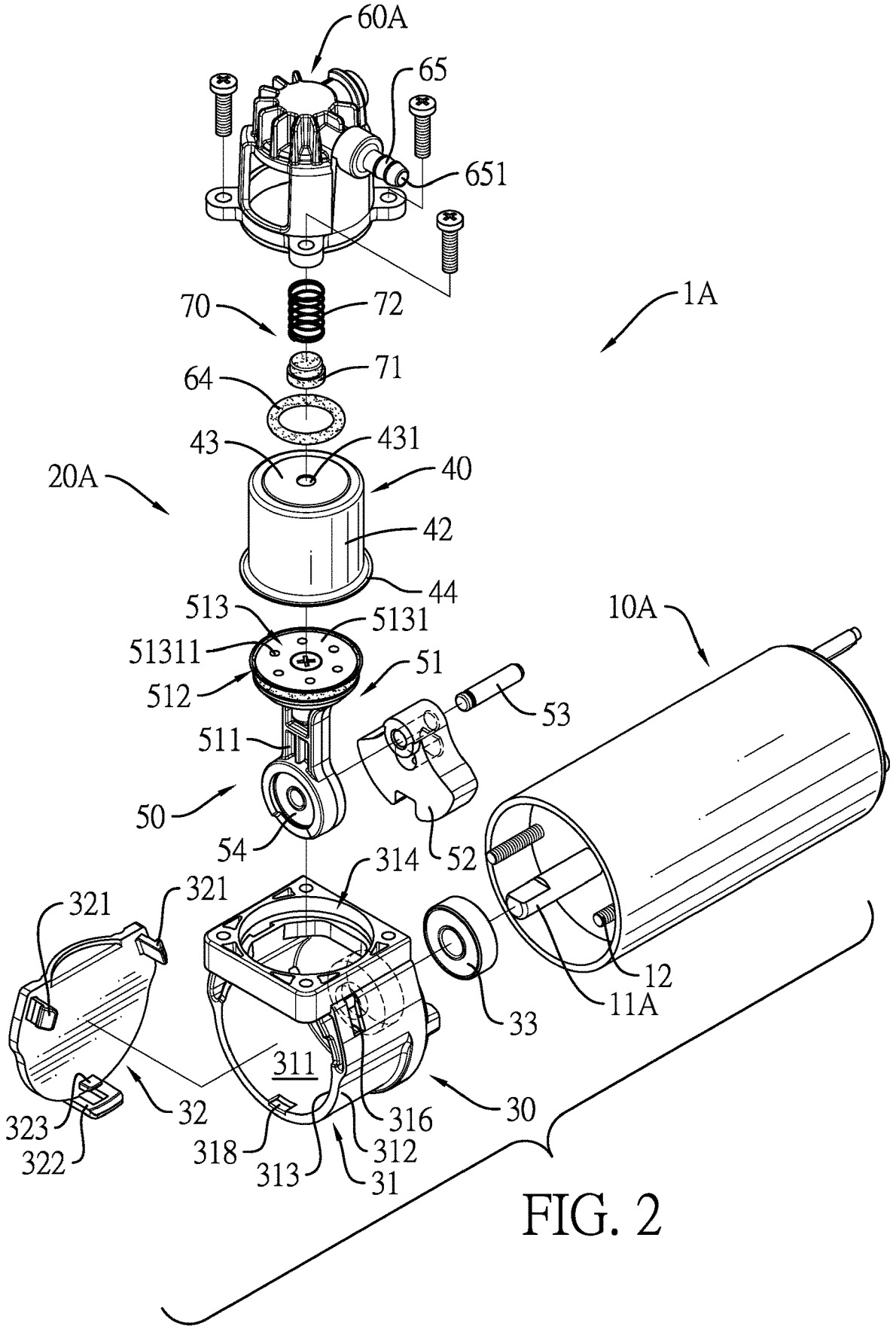
FIG. 2 is an exploded perspective view of the direct drive air pump in FIG. 1.

With reference to FIGS. 1 and 2, a first embodiment of a direct drive air pump 1A in accordance with the present invention comprises a motor 10A and a pumping mechanism 20A. The motor 10A has an end and a driving shaft 11A. The driving shaft 11A is rotatably disposed on the motor 10A and has an end. The pumping mechanism 20A is connected to the end of the driving shaft 11A of the motor 10A and is driven by the motor 10A for pumping.

Figure 3:
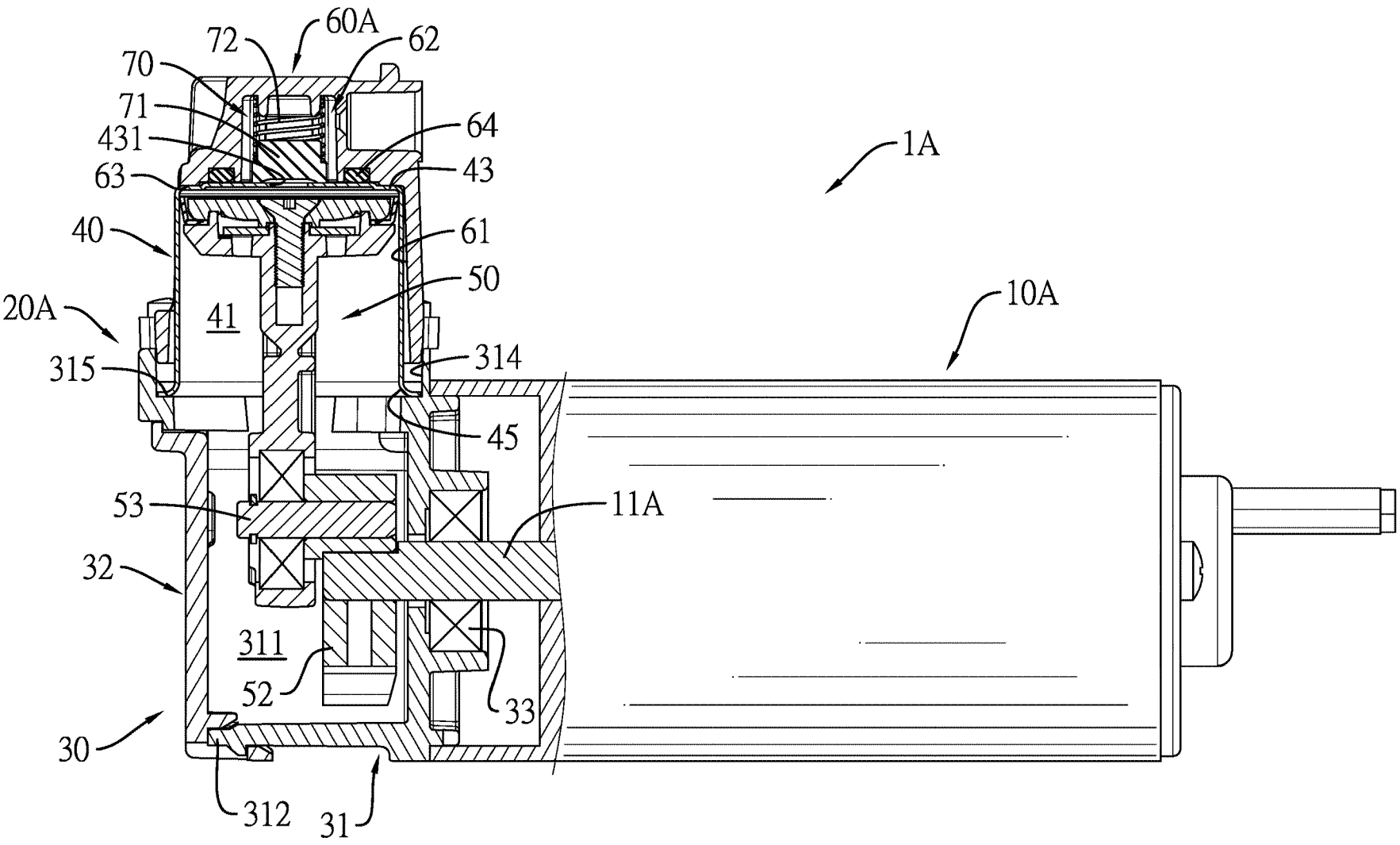
FIG. 3 is a cross sectional side view in partial section of the direct drive air pump in FIGS. 1 and 2.
Figure 4:
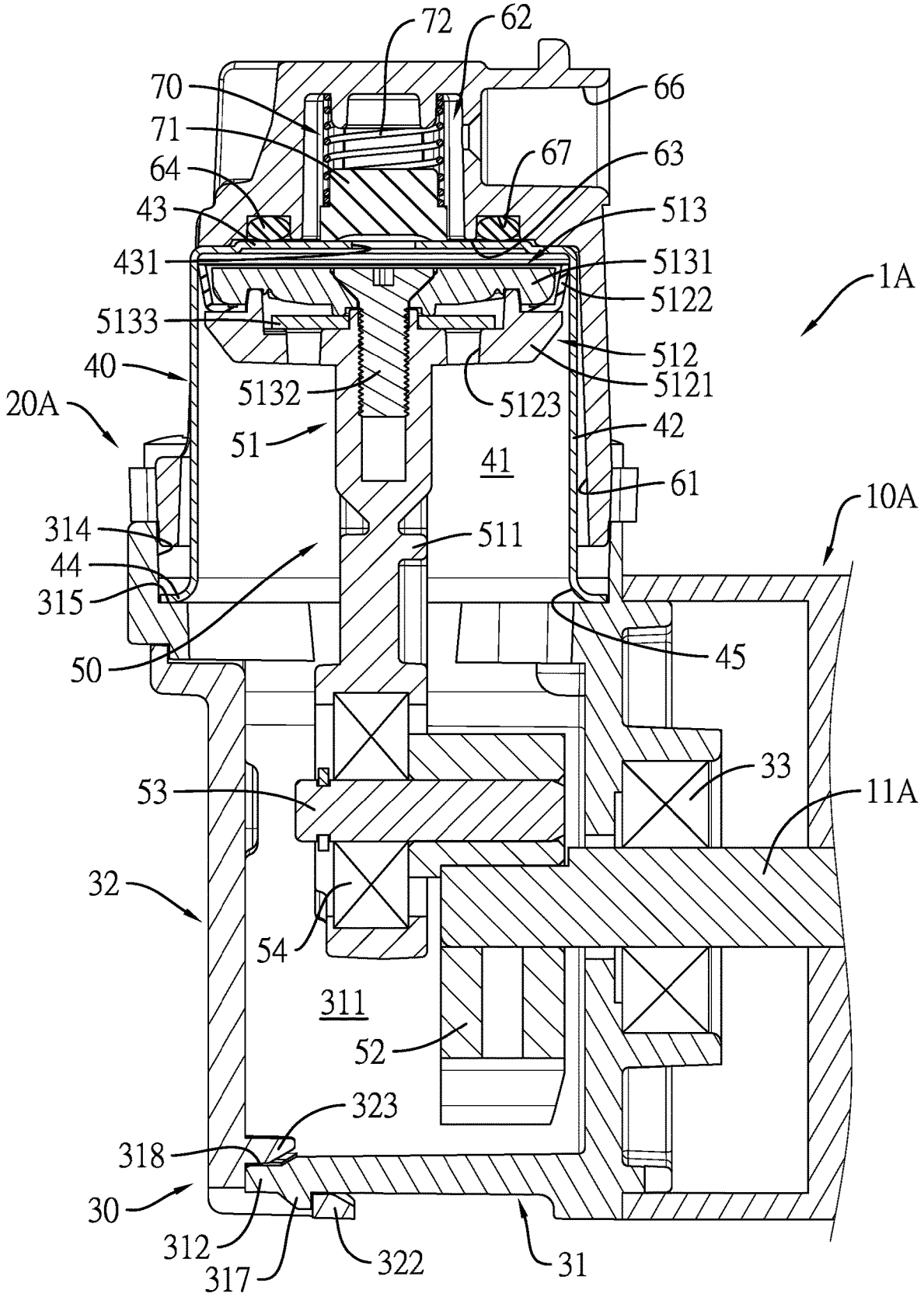
FIG. 4 is an enlarged side view of the direct drive air pump in FIG. 3.

With reference to FIGS. 2 to 4, the pumping mechanism 20A has a cylinder 30, a cylindrical body 40, a piston assembly 50, a cylindrical cover 60A, and a non-return valve 70.

With reference to FIGS. 2 to 4, the cylinder 30 is disposed on the end of the motor 10A by multiple bolts 12. The driving shaft 11A of the motor 10A is inserted into the cylinder 30. A first bearing 33 is disposed between the cylinder 30 and the driving shaft 11A. The cylinder 30 has a seat 31 and a soundproof plate 32. The seat 31 is connected to the motor 10A and has a first side 312, a space 311, and a first opening 313. The first side 312 is formed on the seat 31 opposite to the motor 10A. The space 311 is formed in the seat 31. The driving shaft 11A is inserted into the space 311. The first opening 313 is formed on the first side 312 and communicates with the space 311. The soundproof plate 32 is detachably disposed on the first side 312 of the seat 31 and closes the first opening 313 of the seat 31. Furthermore, the cylinder 30 has a top end and a disposing recess 314. The disposing recess 314 is formed on the top end of the cylinder 30 above the space 311 and communicates with the space 311.

With reference to FIGS. 2 to 4, the soundproof plate 32 engages with the first side 312 of the seat 31. The seat 31 has multiple engaging holes 316, an engaging protrusion 317, and a slot 318. The engaging holes 316 are formed on the first side 312 of the seat 31. The engaging protrusion 317 is formed on an outer-bottom surface of the first side 312 of the seat 31. The slot 318 is formed in the first side 312 of the seat 31, is located above the engaging protrusion 317, and is located in the first opening 313 of the seat 31.

The soundproof plate 32 has a back surface, multiple engaging arms 321, an engaging ring 322, and a plug 323. The back surface faces the first opening 313 of the seat 31 and has a bottom. The engaging arms 321 are formed on the back surface of the soundproof plate 32 and are respectively inserted into the engaging holes 316 of the seat 31. The engaging ring 322 is formed on the bottom end of the back surface of the soundproof plate 32, and engages with the engaging protrusion 317 of the seat 31. The plug 323 is formed on the back surface of the soundproof plate 32 above the engaging ring 322, and is inserted into the slot 318 of the seat 31. The soundproof plate 32 steadily and fixedly engages with the first side 312 of the seat 31 and closes the first opening 313 of the seat 31.

With reference to FIGS. 2 to 4, an inner diameter of the disposing recess 314 is larger than an inner diameter of the space 311. The cylinder 30 has an annular abutting portion 315. The annular abutting portion 315 is formed on the top end of the cylinder 30 below the disposing recess 314 of the cylinder 30.

With reference to FIGS. 2 to 4, the cylindrical body 40 is disposed on the top end of the cylinder 30 and communicates with the space 311 of the seat 31. The cylindrical body 40 has a cylindrical chamber 41, a cylindrical wall 42, a cylindrical opening 45, and a top plate 43. The cylindrical chamber 41 is formed in the cylindrical body 40. The cylindrical wall 42 is formed on the cylindrical body 42, surrounds the cylindrical chamber 41, and has a top end and a bottom end. The cylindrical opening 45 is formed through the bottom end of the cylindrical wall 42 and communicates with the cylindrical chamber 41.

The top plate 43 is integratedly formed on the top end of the cylindrical wall 42, is located above the cylindrical chamber 41, and has an exhaust hole 431. The exhaust hole 431 is formed through the top plate 43 and communicates with the cylindrical chamber 41. The cylindrical body 40 has a bottom end and an annular protrusion 44. The annular protrusion 44 is formed on the bottom end of the cylindrical body 40 and is located around the cylindrical opening 45 of the cylindrical body 40. An inner diameter of the exhaust hole 431 is smaller than an inner diameter of the cylindrical chamber 41. The bottom end of the cylindrical body 40 is disposed into the disposing recess 314 of the cylinder 30. The annular protrusion 44 abuts against the annular abutting portion 315. The cylindrical opening 45 of the cylindrical body 40 communicates with the space 311 of the cylinder 30.

With reference to FIGS. 2 to 4, the piston assembly 50 is connected to the driving shaft 11A of the motor 10A, and is located in the space 311 of the cylinder 30 and the cylindrical chamber 41 of the cylindrical body 40. The piston assembly 50 is driven by the motor 10 to move upwardly and downwardly in the space 311 of the cylinder 30 and the cylindrical chamber 41 of the cylindrical body 40.

With reference to FIGS. 2 to 4, the piston assembly 50 has a piston rod 51, an eccentric transmission 52, and a pivot rod 53. The piston rod 51 is movably disposed on the driving shaft 11A of the motor 10A, and is located in the space 311 of the cylinder 30 and the cylindrical chamber 41 of the cylindrical body 40. The eccentric transmission 52 is pivotally connected to a bottom end of the piston rod 51 and is connected to the driving shaft 11A of the motor 10A. The pivoting rod 53 is inserted through the piston rod 51 and the eccentric transmission 52 and is located beside the driving shaft 11A of the motor 10A. The piston rod 51 linearly moves upwardly and downwardly with a rotation movement of the driving shaft 11A of the motor 10A. A second bearing 54 is disposed on the bottom end of the piston rod 51. The pivoting rod 53 is pivotally disposed into the second bearing 54.

With reference to FIGS. 2 to 4, the piston rod 51 has a rod portion 511 and a piston portion 512. The rod portion 511 is disposed on the driving shaft 11A of the motor 10A and has a top end. The piston portion 512 is disposed on the top end of the rod portion 511. The piston portion 512 is sealingly connected to an inner wall of the cylindrical body 40 and has a check valve 513.

With reference to FIGS. 2 to 4, the piston portion 512 has a piston body 5121, a soft stopper 5122, and a check valve 513. The piston body 5121 is disposed on the top end of the rod portion 511 and has at least one through hole 5123 formed through the piston body 5121. The soft stopper 5122 is disposed around the piston body 5121, is sealingly connected around the cylindrical body 40, and is located in the cylindrical chamber 41 of the cylindrical body 40. The check valve 513 is disposed on the piston body 5121 and has a stopping plate 5131, a fixing rod 5132, and a soft sheet 5133. The stopping plate 5131 is disposed above the piston body 5121 and has at least one connecting hole 51311 formed through the stopping plate 5131. The fixing rod 5132 is inserted through the stopping plate 5131 and is fixedly disposed on the piston body 5121.

The soft sheet 5133 is movably disposed between the stopping plate 5131 and a top surface of the piston body 5121. The fixing rod 5132 is inserted through the soft sheet 5133. The soft sheet 5133 is made of rubber, silicone rubber, or soft plastic, etc. The soft sheet 5133 is able to close the at least one through hole 5123 of the piston body 5121 for reducing the noise. Air flow can uni-directionally flow through the at least one through hole 5123 of the piston body 5121 for pushing the soft sheet 5133. The air flow flows through the at least one connecting hole 51311 of the stopping plate 5131 and flows into a part of the cylindrical chamber 41 of the cylindrical body 40 above the piston portion 512.

With reference to FIGS. 2 to 4, the cylindrical cover 60A is fixedly disposed on a top portion of the cylinder 30 by multiple screws and covers the cylindrical body 40. The cylindrical cover 60A has a bottom surface, an insertion recess 61, an air room 62, an abutting wall 63, an O-ring 64, and a connector 65. The insertion recess 61 is formed on the bottom surface of the cylindrical cover 60A. The air room 62 is formed in the cylindrical cover 60A, and is located above and communicates with the insertion recess 61 of the cylindrical cover 60A and the exhaust hole 431 of the top plate 43. An inner diameter of the air room 62 is smaller than an inner diameter of the insertion recess 61. The abutting wall 63 is formed in the cylindrical cover 60A adjacent to the insertion recess 61 of the cylindrical cover 60A, is located above the insertion recess 61 of the cylindrical cover 60A, is disposed around the air room 62 of the cylindrical cover 60A, and faces the top plate 43. The abutting wall 63 has a bottom surface and an annular recess 67. The annular recess 67 is formed on the bottom surface of the abutting wall 63.

Figure 6:
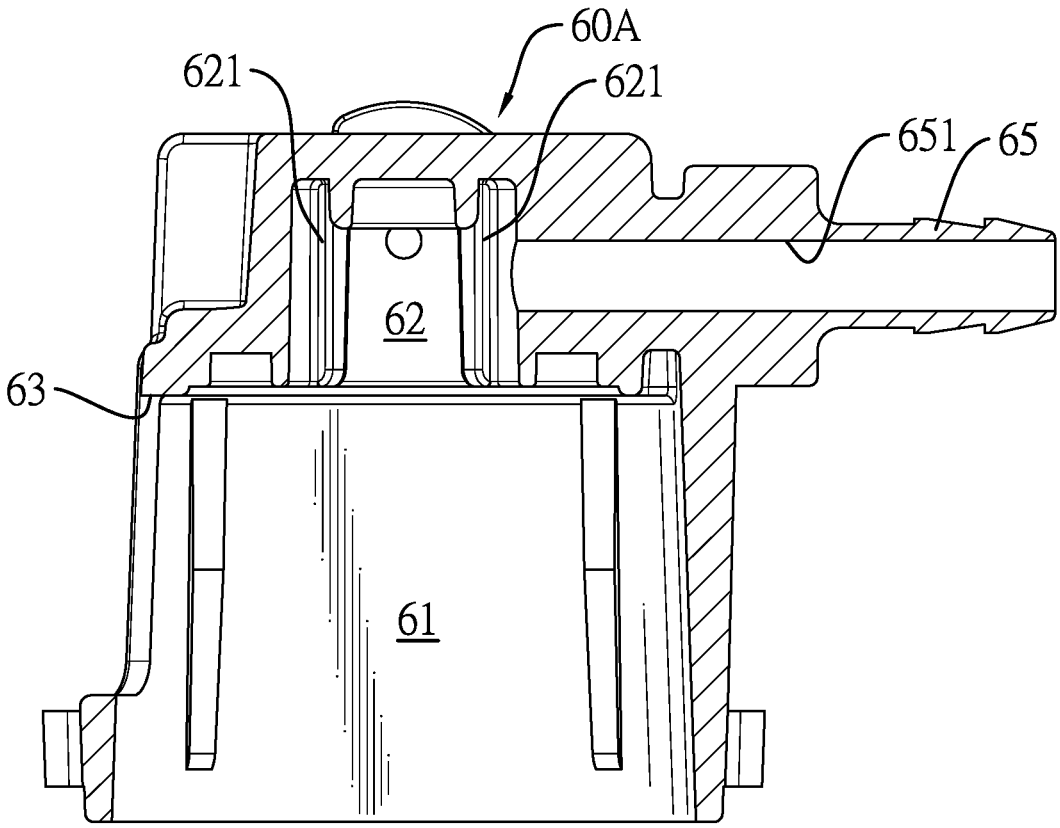
FIG. 6 is an enlarged cross sectional side view of the cylindrical cover of the direct drive air pump in FIGS. 1 to 4.

The O-ring 64 is disposed into the annular recess 67 of the abutting wall 63 and abuts against the top plate 43. The cylindrical body 40 is disposed into the insertion recess 61 of the cylindrical cover 60A. The cylindrical cover 60A is sealingly connected to the top plate 43 of the cylindrical cover 60A by the O-ring 64. The exhaust hole 431 of the top plate 43 communicates with the air room 62 of the cylindrical cover 60A. With reference to FIG. 6, the connector 65 is disposed on the cylindrical cover 60A and has an outlet 651. The outlet 651 is formed through the connector 65 and communicates with the air room 62 of the cylindrical cover 60A. The connector 65 is used to connect to a guiding tube. The cylindrical cover 60A further has a vent 66. The vent 66 is formed on the cylindrical cover 60A and communicates with the air room 62 of the cylindrical cover 60A. When the vent 66 is not in use, the vent 66 can be closed by a stopper. Alternatively, the cylindrical cover 60A does not have the vent 66.

With reference to FIGS. 2 to 4, the non-return valve 70 is disposed in the air room 62 of the cylindrical cover 60A for controlling the exhaust hole 431 of the top plate 43 of the cylindrical body 40 to open and close. Compressed air in the cylindrical body 40 is allowed to uni-directionally flow into the air room 62 of the cylindrical cover 60A. The non-return valve 70 has a valve block 71 and a spring 72. The valve block 71 is a soft component, is movably disposed on the top plate 43 of the cylindrical body 40, and can move upwardly and downwardly. The spring 72 is connected between the valve block 71 and an inner-top wall of the cylindrical cover 60A and is located in the air room 62 of the cylindrical cover 60A. The spring 72 can give a downward force to the valve block 71 for closing the exhaust hole 431. The valve block 71 is made of rubber, silicone rubber, or soft plastic, etc. The valve block 71 is soft and is connected to the top plate 43 of the cylindrical body 40 for well closing the exhaust hole 431 and reducing the noise of collision between the valve block 71 and the top plate 43.

Figure 5:
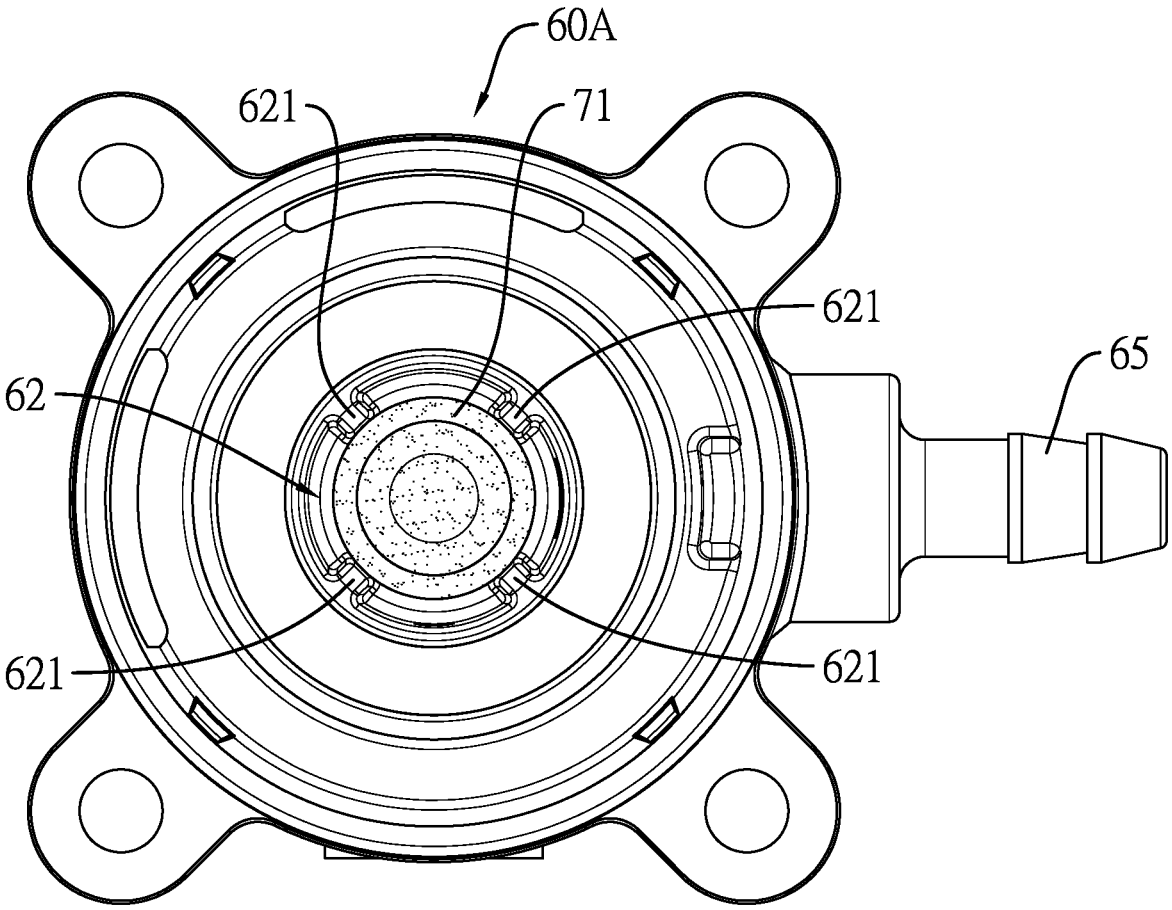
FIG. 5 is a bottom side view of the direct drive air pump in FIGS. 1 to 4, showing a cylindrical cover and a valve block disposed in the cylindrical cover.

With reference to FIG. 5, the cylindrical cover 60A has multiple ribs 621. The ribs 621 are axially formed in the cylindrical cover 60A at spaced intervals, are located in the air room 62 of the cylindrical cover 60A, and are located around the valve block 71 for guiding the valve block 71 to move linearly, upwardly, and downwardly and preventing the valve block from skewing. In addition, multiple channels are formed in the cylindrical cover 60A. Each one of the channels is located between two adjacent ribs 621. In use, the air flow can be flowed through the channels of the cylindrical cover 60A smoothly.

With reference to FIGS. 3 and 4, the first embodiment of the direct drive air pump 1A is in use. The motor 10A is electrically connected to an external power supply to start. The piston assembly 50 is driven by the driving shaft 11A of the motor 10A and moves upwardly and downwardly in the space 311 of the cylinder 30 and the cylindrical chamber 41 of the cylindrical body 40 for pumping.

When the piston assembly 50 moves downwardly, the exhaust hole 431 of the cylindrical body 40 is closed by the non-return valve 70. The part of the cylindrical chamber 41 of the cylindrical body 40 above the piston portion 512 is increased for generating a negative pressure induction effect. An external air flows into the space 311 of the cylinder 30 via an interval between the motor 10A and the cylinder 30 or an interval between the seat 31 of the cylinder 30 and the soundproof plate 32, and then flows into the part of the cylindrical chamber 41 of the cylindrical body 40 above the piston portion 512 via the check valve 513 of the piston portion.

When the piston assembly 50 is moved upwardly by the motor 10A, the check valve 513 of the piston portion 512 is closed. The compressed air in the part of the cylindrical chamber 41 of the cylindrical body 40 above the piston portion 512 is compressed, and then pushes the valve block 71 of the non-return valve 70. The valve block 71 moves upwardly, compresses the spring 72, and leaves the top plate 43. The exhaust hole 431 of the cylindrical body 40 is in an open state. The compressed air in the cylindrical chamber 41 of the cylindrical body 40 can flow through the exhaust hole 431 of the cylindrical body 40, flows around and through the check valve 513, flows into the air room 62 of the cylindrical cover 60A, and flows out of the outlet 651 of the connector 65 of the cylindrical cover 60A. The piston assembly 50 driven by the motor 10A moves upwardly, downwardly, and repeatedly for pumping continuously.

Figure 7:
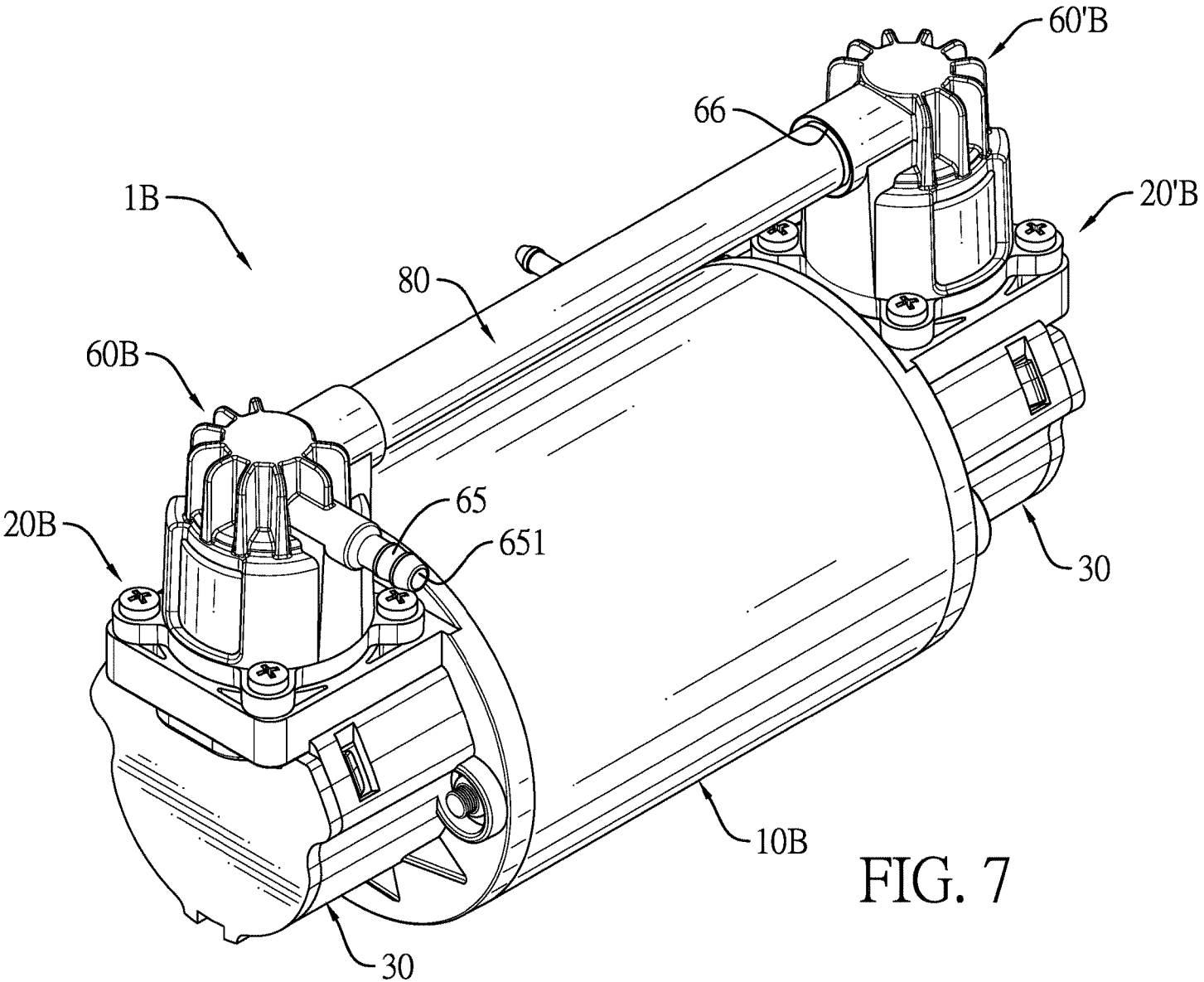
FIG. 7 is a perspective view of a second embodiment of a direct drive air pump in accordance with the present invention.
Figure 8:
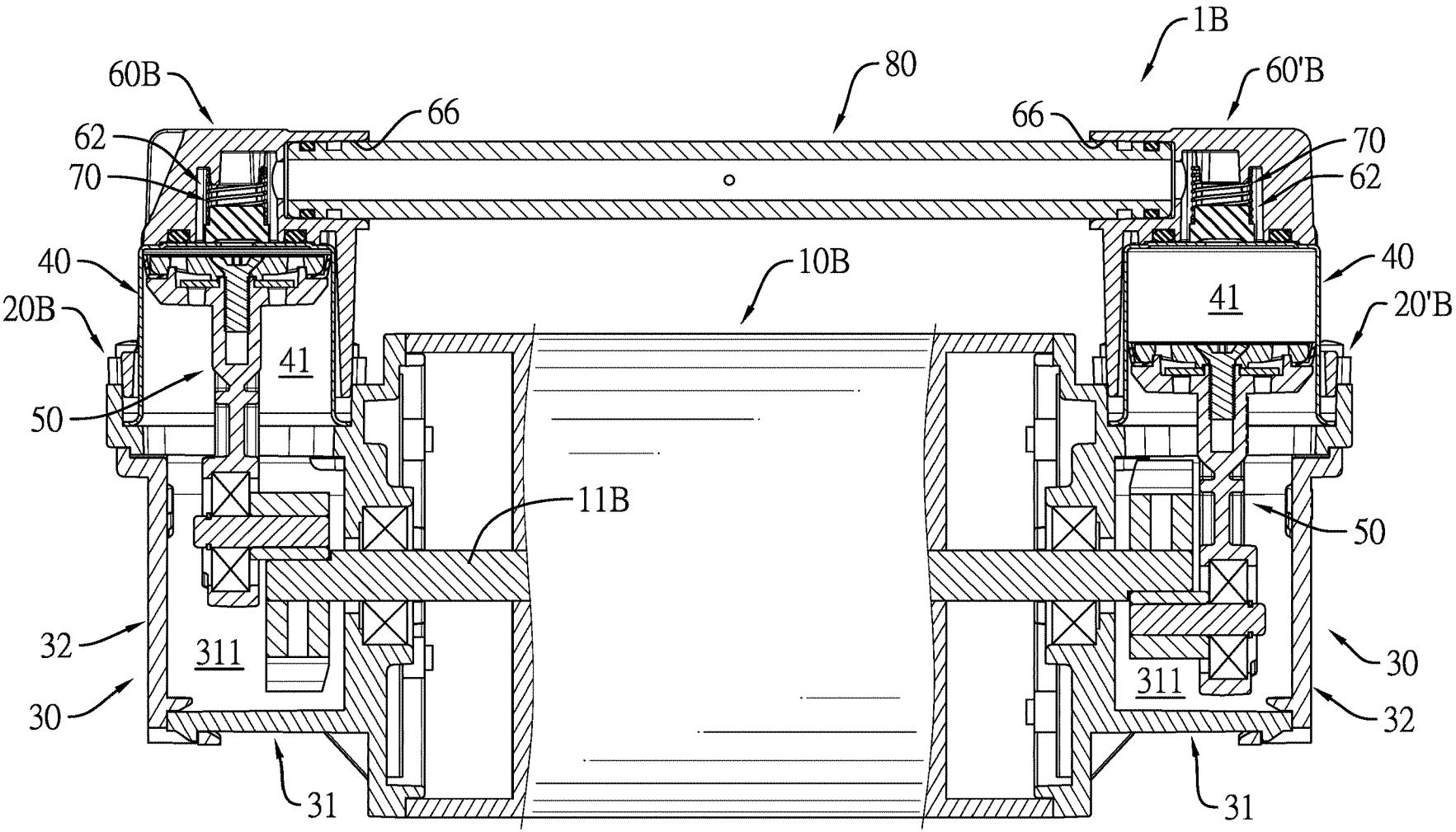
FIG. 8 is a cross sectional side view of the direct drive air pump in FIG. 7.
Figure 9:
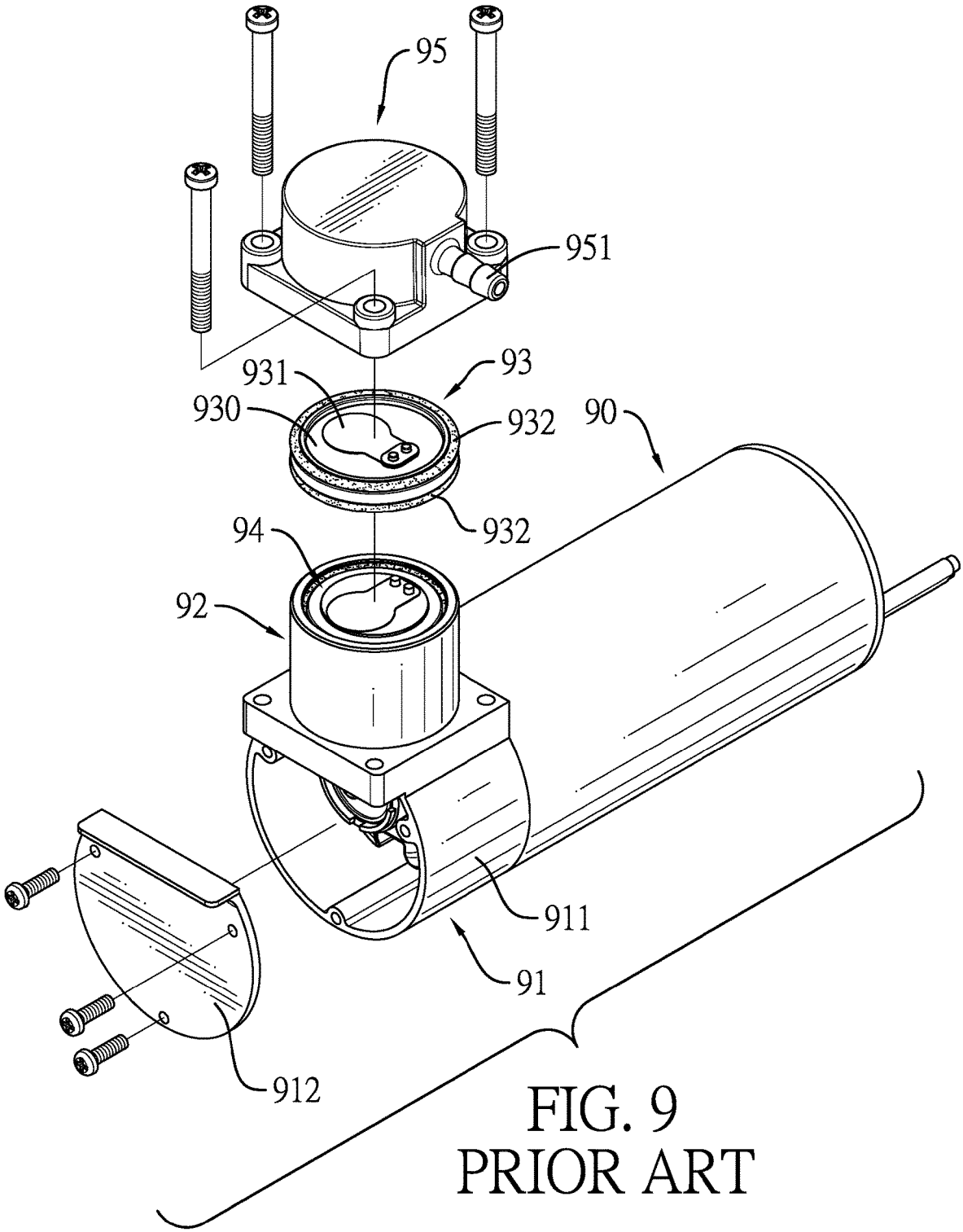
FIG. 9 PRIOR ART
FIG. 9 is an exploded perspective view of an air pump in accordance with the prior art.
Figure 10:
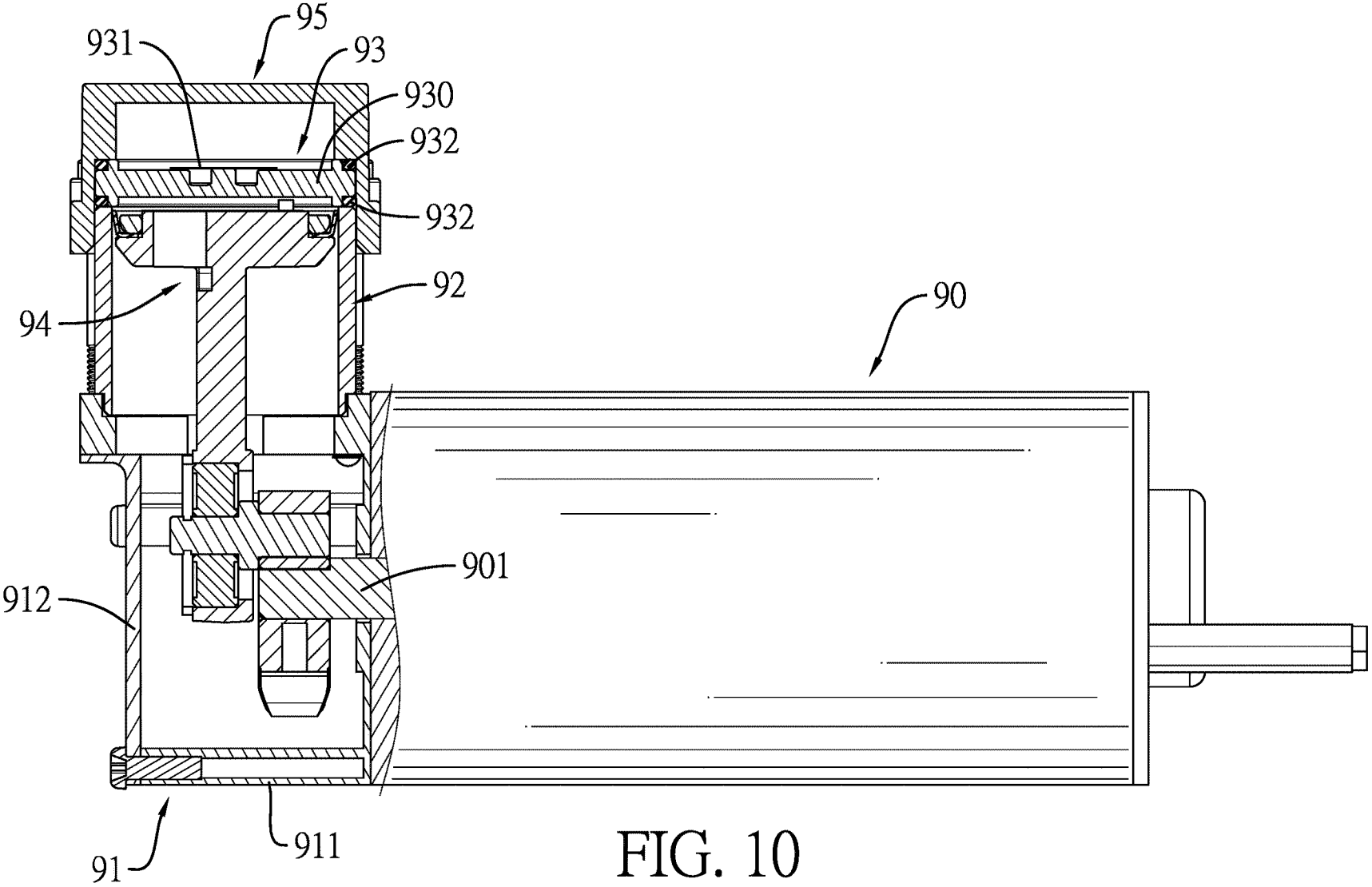
FIG. 10 PRIOR ART
FIG. 10 is a partial cross sectional side view of the air pump in FIG. 9.

With reference to FIGS. 7 and 8, a structure of a second embodiment of the direct drive air pump 1B is based on a structure of the first embodiment of the direct drive air pump 1A. The second embodiment of the direct drive air pump 1B has an auxiliary pumping mechanism 20'B and a tube 80. Namely, the second embodiment of the direct drive air pump 1B has the motor 10B, the pumping mechanism 20B, the auxiliary pumping mechanism 20'B, and the tube 80. The motor 10B has two ends and the driving shaft 11B. The driving shaft 11B is rotatably disposed on the motor 10B and has two ends. The pump mechanism 20B and the auxiliary pumping mechanism 20'B are respectively connected to the two ends of the driving shaft 11B of the motor 10B. The tube 80 is connected with the pumping mechanism 20B and the auxiliary pumping mechanism 20'B. The motor 10B can drive the pumping mechanism 20B and the auxiliary pumping mechanism 20'B to pump continuously and alternately.

With reference to FIGS. 7 and 8, structures of the pumping mechanism 20B and the auxiliary pumping mechanism 20'B in the second embodiment of the direct drive air pump 1B are both similar to a structure of the pumping mechanism 20A in the first embodiment of the direct drive air pump 1A. Namely, each one of the pumping mechanism 20B and the auxiliary pumping mechanism 20'B in the second embodiment of the direct drive air pump 1B has the cylinder 30, the cylindrical body 40, a piston assembly 50, a non-return valve 70, and the cylindrical cover 60B, 60'B. The structures of the pumping mechanism 20B and the auxiliary pumping mechanism 20'B in the second embodiment of the direct drive air pump 1B will not be described herein.

With reference to FIGS. 7 and 8, the difference between each one of the pumping mechanism 20B and the auxiliary pumping mechanism 20'B in the second embodiment of the direct drive air pump 1B and the pumping mechanism 20A in the first embodiment of the direct drive air pump 1A is described as follows. In the second embodiment of the direct drive air pump 1B, the cylindrical cover 60B has the connector 65 having the outlet 651 and the vent 66. The outlet 651 of the connector 65 and the vent 66 both communicates with the air room 62 of the cylindrical cover 60B.

The cylindrical cover 60'B of the auxiliary pumping mechanism 20'B has the vent 66, too. The vent 66 in the auxiliary pumping mechanism 20'B communicates with the air room 62 of the cylindrical cover 60'B. Two ends of the tube 80 are respectively inserted through the vent 66 in the pumping mechanism 20B and the vent 66 in the auxiliary pumping mechanism 20'B. The pumping mechanism 20B and the auxiliary pumping mechanism 20'B alternately generate the pressed airs. The pressed airs co-flow out of the outlet 651 of the connector 54 of the pumping mechanism 20B.

With reference to FIGS. 7 and 8, the second embodiment of the direct drive air pump 1B is in use. The motor 10B is electrically connected to the external power supply to start. The piston assemblies 50 of the pumping mechanism 20B and the auxiliary pumping mechanism 20'B are driven by the driving shaft 11B of the motor 10B. Each piston assembly 50 moves upwardly and downwardly in the space 311 of the cylinder 30 and the cylindrical chamber 41 of the cylindrical body 40 for pumping. The motions of the pumping mechanism 20B and the auxiliary pumping mechanism 20'B are both same to the motion of the pumping mechanism 20A in the first embodiment of the direct drive air pump 1A, and will not be described herein.

In the second embodiment of the direct drive air pump 1B, the two ends of the driving shaft 11B of the single motor 10B are respectively connected to the pumping mechanism 20B and the auxiliary pumping mechanism 20'B. When the piston assembly 50 of the pumping mechanism 20B moves upwardly, the piston assembly 50 of the auxiliary pumping mechanism 20'B moves downwardly and simultaneously. The piston assembly 50 of the pumping mechanism 20B moves upwardly in a corresponding space 311 and a corresponding cylindrical chamber 41 to generate a pressing effect. Simultaneously, the piston assembly 50 of the auxiliary pumping mechanism 20'B moves downwardly in a corresponding space 311 and a corresponding cylindrical chamber 41 to generate a sucking effect. Conversely, the pumping mechanism 20B generates the sucking effect, and the auxiliary pumping mechanism 20'B generates the pressing effect. Therefore, the pressing effect and the sucking effect are alternately generated with the pumping mechanism 20B and the auxiliary pumping mechanism 20'B. The pressing air can be guided by the tube 80, and then flows out of the connector 65 of the pumping mechanism 20B for increasing the pumping effect of the direct drive air pump 1B.

What is claimed is:

1. A direct drive air pump comprising:
- a motor having an end and a driving shaft, and the driving shaft rotatably disposed on the motor and having an end; and
- a pumping mechanism connected to the end of the driving shaft of the motor, and having
  - a cylinder disposed on the end of the motor and having a top end and a space formed in the cylinder, wherein the driving shaft of the motor is inserted into the space of the cylinder;
  - a cylindrical body disposed on the top end of the cylinder, and having
    - a cylindrical chamber formed in the cylindrical body;
    - a cylindrical wall formed on the cylindrical body, surrounding the cylindrical chamber, and having a top end and a bottom end;
    - a cylindrical opening formed through the bottom end of the cylindrical wall and communicating with the cylindrical chamber; and
    - a top plate integratedly formed on the top end of the cylindrical wall, located above the cylindrical chamber, and having
      - an exhaust hole formed through the top plate and communicating with the cylindrical chamber;
  - a piston assembly, which is connected to the driving shaft of the motor and located in the space of the cylinder and the cylindrical chamber of the cylindrical body, and further including
    - a piston rod that is movably disposed on the driving shaft of the motor, which is located in the space of the cylinder and the cylindrical chamber of the cylindrical body, and having
      - a rod portion disposed on the driving shaft of the motor and having a top end; and
      - a piston portion disposed on the top end of the rod portion, and having
        - a piston body disposed on the top end of the rod portion and having at least one through hole formed through the piston body;
        - a soft stopper disposed around the piston body, sealingly connected around the cylindrical body, and located in the cylindrical chamber of the cylindrical body; and a check valve disposed on the piston body and having a stopping plate disposed above the piston body and having at least one connecting hole formed through the stopping plate;

a fixing rod inserted through the stopping plate and fixedly, disposed on the piston body; and a soft sheet movably disposed between the stopping plate and the piston body, wherein the fixing rod is inserted through the soft sheet, and the soft sheet is able to close the at least one through hole of the piston body;

an eccentric transmission pivotally connected to the rod portion of the piston rod, and connected to the driving shaft of the motor; and a pivoting rod inserted through the rod portion and the eccentric transmission, and located beside the driving shaft of the motor;

wherein the piston assembly is driven by the motor to move upwardly and downwardly in the space of the cylinder and the cylindrical chamber of the cylindrical body;

a cylindrical cover covering the cylindrical body, fixedly disposed on the cylinder, and having a bottom surface;

an insertion recess formed on the bottom surface of the cylindrical cover;

an air room, which is formed in the cylindrical cover, and is located above the insertion recess of the cylindrical cover and communicating with the insertion recess of the cylindrical cover and the exhaust hole of the top plate;

an abutting wall formed in the cylindrical cover adjacent, to the insertion recess of the cylindrical cover, located above the insertion recess of the cylindrical cover, disposed around the air room of the cylindrical cover, and facing the top plate;

an O-ring disposed on the abutting wall and abutting against the top plate; and a connector disposed on the cylindrical cover and having an outlet formed through the connector and communicating with the air room of the cylindrical cover; and a non-return valve disposed in the air room of the cylindrical cover for controlling the exhaust hole that is formed through the top plate of the cylindrical body to open and close, and having a valve block, which is a soft component and movably disposed on the top plate of the cylindrical body; and a spring connected between the valve block and an inner-top wall of the cylindrical cover.

2. The direct drive air pump as claimed in claim 1, wherein the cylinder has a seat connected to the motor, and having a first side formed on the seat opposite to the motor;

the space of the cylinder formed in the seat; and a first opening formed on the first side and communicating with the space of the cylinder; and a soundproof plate engaging with the first side of the seat and closing the first opening of the seat.

3. The direct drive air pump as claimed in claim 2, wherein the seat has multiple engaging holes formed on the first side of the seat;

an engaging protrusion formed on an outer-bottom surface of the first side of the seat; and a slot formed in the first side of the seat, located above the engaging protrusion, and located in the first opening of the seat; and the soundproof plate has a back surface facing the first opening of the seat and having a bottom end;

multiple engaging arms formed on the back surface of the soundproof plate and respectively inserted into the engaging holes of the seat;

an engaging ring formed on the bottom end of the back surface of the soundproof plate, and engaging with the engaging protrusion of the seat; and a plug formed on the back surface of the soundproof plate above the engaging ring, and inserted into the slot that is formed in the first side of the seat.

4. The direct drive air pump as claimed in claim 1, wherein the cylindrical cover has multiple ribs, the multiple ribs are axially formed in the cylindrical cover at spaced intervals, are located in the air room of the cylindrical cover, and are located around the valve block for guiding the valve block to move linearly, upwardly, and downwardly.

5. The direct drive air pump as claimed in claim 2, wherein the cylindrical cover has multiple ribs, the multiple ribs are axially formed in the cylindrical cover at spaced intervals, are located in the air room of the cylindrical cover, and are located around the valve block for guiding the valve block to move linearly, upwardly, and downwardly.

6. The direct drive air pump as claimed in claim 1, wherein the cylinder has a disposing recess formed on the top end of the cylinder above the space of the cylinder; and an annular abutting portion formed on the top end of the cylinder below the disposing recess of the cylinder;

the cylindrical body has a bottom end; and an annular protrusion formed on the bottom end of the cylindrical body and located around the cylindrical opening of the cylindrical body; and wherein the bottom end of the cylindrical body is disposed into the disposing recess of the cylinder, and the annular protrusion abuts against the annular abutting portion.

7. The direct drive air pump as claimed in claim 1, wherein the cylindrical cover has multiple ribs axially formed in the cylindrical cover at spaced intervals, located in the air room of the cylindrical cover, and located around the valve block for guiding the valve block to move linearly, upwardly, and downwardly;

the cylinder has a disposing recess formed on the top end of the cylinder above the space o the cylinder; and an annular abutting portion formed on the top end of the cylinder below the disposing recess of the cylinder;

the cylindrical body has a bottom end; and an annular protrusion formed on the bottom end of the cylindrical body and located around the cylindrical opening of the cylindrical body; and wherein the bottom end of the cylindrical body is disposed into the disposing recess of the cylinder, and the annular protrusion abuts against the annular abutting portion.

8. The direct drive air pump as claimed in claim 2, wherein the cylindrical cover has multiple ribs axially formed in the cylindrical cover at spaced intervals, located in the air room of the cylindrical cover, and located around the valve block for guiding the valve block to move linearly, upwardly, and downwardly;

the cylinder has a disposing recess formed on the top end of the cylinder above the space of the cylinder; and an annular abutting portion formed on the top end of the cylinder below the disposing recess of the cylinder;

the cylindrical body has a bottom end; and an annular protrusion formed on the bottom d of the cylindrical body and located around the cylindrical opening of the cylindrical body; and wherein the bottom end of the cylindrical body is disposed into the disposing recess of the cylinder, and the annular protrusion abuts against the annular abutting portion.

9. The direct drive air pump as claimed in claim 1, wherein the cylindrical cover has multiple ribs axially formed in the cylindrical cover at spaced intervals, located in the air room of the cylindrical cover, and located around the valve block for guiding the valve block to move linearly, upwardly, and downwardly;

the cylinder has a disposing recess formed on the top end of the cylinder above the space of the cylinder; and an annular abutting portion formed on the top end of the cylinder below the disposing recess of the cylinder;

the cylindrical body has a bottom end; and an annular protrusion formed on the bottom end of the cylindrical body and located around the cylindrical opening of the cylindrical body; and wherein the bottom end of the cylindrical body is disposed into the disposing recess of the cylinder, and the annular protrusion abuts against the annular abutting portion.

* * * * *